US010485325B2

(12) United States Patent
Oh et al.

(10) Patent No.: US 10,485,325 B2
(45) Date of Patent: Nov. 26, 2019

(54) COSMETIC VESSEL

(71) Applicant: LG HOUSEHOLD & HEALTH CARE LTD., Seoul (KR)

(72) Inventors: Se Woong Oh, Daejeon (KR); Ha Young Kim, Daejeon (KR); Sung Hwan Kim, Daejeon (KR); Sang Wook Park, Daejeon (KR); Gu Yong Lee, Seoul (KR); Ji Mi Baek, Seoul (KR); Ok Hee Jung, Seoul (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 439 days.

(21) Appl. No.: 15/231,321

(22) Filed: Aug. 8, 2016

(65) Prior Publication Data

US 2017/0354230 A1 Dec. 14, 2017

(30) Foreign Application Priority Data

Jun. 10, 2016 (KR) ..... 10-2016-0072758

(51) Int. Cl.
*A45D 33/02* (2006.01)
*A45D 40/22* (2006.01)
(Continued)

(52) U.S. Cl.
CPC ..... *A45D 40/22* (2013.01); *B05B 1/18* (2013.01); *A45D 2200/056* (2013.01);
(Continued)

(58) Field of Classification Search
CPC ... B05B 1/18; B05B 11/0037; B05B 11/3001; B05B 11/00418; B05B 11/0032;
(Continued)

(56) References Cited

U.S. PATENT DOCUMENTS 4,982,751 A * 1/1991 Oishi ..... A45D 33/02 132/299
5,548,085 A * 8/1996 Flores ..... H02B 1/28 174/366
(Continued)

FOREIGN PATENT DOCUMENTS

CN 1165768 A 11/1997
CN 1254302 A 5/2000
(Continued)

OTHER PUBLICATIONS

[Reporter: Jin Woo Kim of E-Daily], "LG Household & Health Care Ltd. selects a 'former Wonder Girls member', So Hee Ahn, for the new VDL model", E-Daily, Feb. 12, 2016, 2 pages, URL: http://www.edaily.co.kr/news/NewsRead.edy?SCD=JC21&newsid=01423526612549864&DCD=A00302&OutLnkChk=Y.
(Continued)

*Primary Examiner* — Nicholas D Lucchesi
(74) *Attorney, Agent, or Firm* — Birch, Stewart, Kolasch & Birch, LLP

(57) ABSTRACT

There is provided a cosmetic vessel. The cosmetic vessel includes an airless pump configured to discharge cosmetics accommodated therein by using a piston that rises in a cylinder, a discharge plate provided at one side of the airless pump and having at least one discharge hole, and a guide unit provided between the airless pump and the discharge plate. A lower end of the guide unit is combined with the piston and rises or falls in a state of being integrated with the piston.

17 Claims, 3 Drawing Sheets

(51) Int. Cl.
*B05B 1/18* (2006.01)
*B05B 11/00* (2006.01)

(52) U.S. Cl.
CPC ..... *B05B 11/0032* (2013.01); *B05B 11/00418* (2018.08); *B05B 11/3023* (2013.01)

(58) Field of Classification Search
CPC ... B05B 11/3023; A45D 33/20; A45D 33/006; A45D 33/025; A45D 33/06; A45D 33/003; A45D 33/00; A45D 33/02; A45D 40/0075; A45D 40/22; A45D 34/00; A45D 2200/005; A45D 2200/056; A45D 2200/1018; A45D 2200/155
See application file for complete search history.

(56) References Cited

U.S. PATENT DOCUMENTS

| | | | | |
|---|---|---|---|---|
| 5,762,946 | A | 6/1998 | Gueret | |
| 8,021,064 | B2 | 9/2011 | Gueret | |
| 8,021,069 | B2 * | 9/2011 | Baghdasarian | B64G 1/645 337/401 |
| 10,010,153 | B2 * | 7/2018 | Kim | A45D 34/00 |
| 2003/0213723 | A1 | 11/2003 | Lombardi | |
| 2005/0109363 | A1 * | 5/2005 | Matsuoka | A45D 33/02 132/298 |
| 2007/0205233 | A1 | 9/2007 | Petit et al. | |
| 2008/0264440 | A1 * | 10/2008 | Thorpe | A45D 33/02 132/299 |
| 2008/0279616 | A1 * | 11/2008 | Thorpe | A45D 34/04 401/265 |
| 2009/0188517 | A1 | 7/2009 | Thorpe et al. | |
| 2011/0278328 | A1 * | 11/2011 | Kang | B05B 11/3023 222/340 |
| 2012/0125361 | A1 * | 5/2012 | Yeom | A45D 33/025 132/293 |
| 2012/0305606 | A1 * | 12/2012 | Lee | A45D 33/02 222/256 |
| 2014/0069840 | A1 * | 3/2014 | Park | A45D 33/003 206/525 |
| 2015/0079802 | A1 * | 3/2015 | Wen | H01L 21/6719 438/745 |
| 2015/0079862 | A1 | 3/2015 | Jeong et al. | |
| 2015/0230586 | A1 | 8/2015 | Thorpe | |
| 2016/0015149 | A1 * | 1/2016 | Kim | A45D 34/00 222/383.1 |
| 2016/0073761 | A1 * | 3/2016 | Lee | A45D 33/025 132/298 |
| 2016/0073762 | A1 * | 3/2016 | Lee | A45D 34/04 222/145.6 |
| 2016/0136666 | A1 | 5/2016 | Kang | |
| 2016/0242529 | A1 | 8/2016 | Oh et al. | |
| 2016/0303602 | A1 | 10/2016 | Kang | |

FOREIGN PATENT DOCUMENTS

| | | | |
|---|---|---|---|
| CN | 2618486 | Y | 6/2004 |
| CN | 200959917 | Y | 10/2007 |
| CN | 101301140 | A | 11/2008 |
| CN | 201192162 | Y | 2/2009 |
| CN | 101779858 | A | 7/2010 |
| CN | 201743143 | U | 2/2011 |
| CN | 201847054 | U | 6/2011 |
| CN | 202890958 | U | 4/2013 |
| CN | 203399790 | U | 1/2014 |
| JP | 59-25704 | A | 2/1984 |
| JP | 59-184709 | U | 12/1984 |
| JP | 60-97513 | U | 7/1985 |
| JP | 62-127216 | U | 8/1987 |
| JP | 64-43819 | U | 3/1989 |
| JP | 1-72818 | U | 5/1989 |
| JP | 1-91423 | U | 6/1989 |
| JP | 1-164922 | U | 11/1989 |
| JP | 1-164924 | U | 11/1989 |
| JP | 4-91888 | U | 8/1992 |
| JP | 5-23135 | Y2 | 6/1993 |
| JP | 6-1082 | Y2 | 1/1994 |
| JP | 6-2605 | Y2 | 1/1994 |
| JP | 8-156940 | A | 6/1996 |
| JP | 8-336418 | A | 12/1996 |
| JP | 10-194308 | A | 7/1998 |
| JP | 3061178 | U | 9/1999 |
| JP | 2000-129448 | A | 5/2000 |
| JP | 2001-19055 | A | 1/2001 |
| JP | 2001-292827 | A | 10/2001 |
| JP | 2002-10827 | A | 1/2002 |
| JP | 2003-275660 | A | 9/2003 |
| JP | 3452688 | B2 | 9/2003 |
| JP | 2004-208975 | A | 7/2004 |
| JP | 3765897 | B2 | 4/2006 |
| JP | 3853952 | B2 | 12/2006 |
| JP | 4129175 | B2 | 8/2008 |
| JP | 2009-11801 | A | 1/2009 |
| JP | 4338383 | B2 | 10/2009 |
| JP | 4590593 | B2 | 12/2010 |
| JP | 4738026 | B2 | 8/2011 |
| JP | 2012-206774 | A | 10/2012 |
| JP | 2013-116192 | A | 6/2013 |
| KR | 20-0370308 | Y1 | 12/2004 |
| KR | 20-0372911 | Y1 | 1/2005 |
| KR | 20-0383969 | Y1 | 5/2005 |
| KR | 20-0402608 | Y1 | 12/2005 |
| KR | 20-0416530 | Y1 | 5/2006 |
| KR | 10-0591522 | B1 | 6/2006 |
| KR | 10-0751835 | B1 | 8/2007 |
| KR | 10-0776286 | B1 | 11/2007 |
| KR | 10-0781747 | B1 | 12/2007 |
| KR | 10-0841441 | B1 | 6/2008 |
| KR | 20-0450515 | Y1 | 10/2010 |
| KR | 20-0453355 | Y1 | 4/2011 |
| KR | 10-2011-0063318 | A | 6/2011 |
| KR | 20-2011-0008182 | U | 8/2011 |
| KR | 10-1103188 | B1 | 1/2012 |
| KR | 20-2012-0000763 | U | 2/2012 |
| KR | 20-0459637 | Y1 | 4/2012 |
| KR | 10-1157218 | B1 | 7/2012 |
| KR | 10-1159135 | B1 | 7/2012 |
| KR | 20-0461424 | Y1 | 7/2012 |
| KR | 10-1171305 | B1 | 8/2012 |
| KR | 20-0461897 | Y1 | 8/2012 |
| KR | 20-0467991 | Y1 | 7/2013 |
| KR | 10-2013-0116194 | A | 10/2013 |
| KR | 20-2013-0006083 | U | 10/2013 |
| KR | 20-0470006 | Y1 | 11/2013 |
| KR | 10-1355364 | B1 | 1/2014 |
| KR | 20-0470757 | Y1 | 1/2014 |
| KR | 10-1429089 | B1 | 8/2014 |
| KR | 10-2014-0121797 | A | 10/2014 |
| KR | 20-2014-0005481 | U | 10/2014 |
| KR | 20-2014-0005553 | U | 10/2014 |
| KR | 10-2014-0146982 | A | 12/2014 |
| KR | 20-2015-0000353 | U | 1/2015 |
| KR | 20-0475944 | Y1 | 1/2015 |
| KR | 10-1494168 | B1 | 2/2015 |
| KR | 20-0476239 | Y1 | 2/2015 |
| KR | 10-2015-0087772 | A | 7/2015 |
| KR | 10-2015-0096602 | A | 8/2015 |
| KR | 10-2015-0096608 | A | 8/2015 |
| KR | 20-0478242 | Y1 | 9/2015 |
| KR | 10-1597076 | B1 | 2/2016 |
| KR | 20-2017-0000470 | U | 2/2017 |
| WO | WO 2005/082200 | A1 | 9/2005 |
| WO | WO 2006/033559 | A1 | 3/2006 |
| WO | WO 2008/007832 | A1 | 1/2008 |
| WO | WO 2014/014198 | A1 | 1/2014 |
| WO | WO 2015/056902 | A1 | 4/2015 |

(56) References Cited

FOREIGN PATENT DOCUMENTS

| | | |
|---|---|---|
| WO | WO 2015/072732 A1 | 5/2015 |
| WO | WO 2015/088100 A1 | 6/2015 |

OTHER PUBLICATIONS

[Reporter: Su Jin Park of Sisaon], "LG Household & Health Care Ltd. releases VDL Expert Metal Cushion Foundation", Sisaon, Mar. 2, 2016, 3 pages, URL: http://www.sisaon.co.kr/news/articleView.html?idxno=41862.
VDL Cosmetics, "VDL Meets So Hee", Feb. 18, 2016, 2 pages, URL: http://instagram.com//vdl_cosmetics.
"Mule ice foundcealer," BEAUTY+, Jul. 17, 2013, pp. 1-20 (21 pages total), with an English summary.
"Mule ice foundcealer," Ce'Ci, Jul. 25, 2013, pp. 1-7 (8 pages total), with an English summary.
English Summary of Result of Invalidation Trial for Korean Patent No. 10-1566114-B1, Nov. 2016, 1 page.
Invalidation Trial Request for Korean Patent No. 10-1471339-B1, dated Sep. 18, 2015, pp. 1-37 (42 pages total).
Invalidation Trial Request for Korean Patent No. 10-1566114-B1, dated Jan. 22, 2016, pp. 1-35 (37 pages total).
LG Household & Health Care, Announcement of product launch of "Beauty Metal Cushion Foundation with screenshots," Mar. 14, 2014, pp. 1-2 (Total 3 pages), along with an English translation.
Preparatory Pleadings of Appeal against Invalidation Trial with regard to KR-10-1471339-B1, dated Dec. 20, 2016, pp. 1-28 (33 pages total), with English Summary.
Result of Invalidation Trial for Korean Patent No. 10-1471339-B1, decided Oct. 6, 2016, pp. 1-28 (29 pages total), with a partial English translation.
Screenshot of a blog post describing a stainless steel type, Feb. 17, 2014, pp. 3-5 (Total 6 pages), along with a partial English translation.
Screenshot of an online shopping website selling a shower head using SUS, 7 pages, Oct. 2009, along with an English summary.
VDL, Blog screenshot regarding VDL Beauty Metal Cushion Foundation, pp. 1-2 and 7-11 (Total 13 pages), Mar. 31, 2014, along with an English summary.
VDL, Photographs of disassembly of VDL Beauty Metal Cushion Foundation, Mar. 2014, 6 pages, along with an English summary.
Web Site: ezday mania, "IOPE Retigen Smoothing Powder", Mar. 21, 2012, <http://www.ezday.co.kr/bbs/view_board.html?q_sq_board=3500546>, see p. 5, lines 1-4; first picture, second picture on p. 5, 8 pages total, with English summary.

* cited by examiner

COSMETIC VESSEL

CROSS-REFERENCE TO RELATED APPLICATION

This application claims priority to Korean Patent Application No. 10-2016-0072758 filed on Jun. 10, 2016, the entire contents of which are incorporated herein by reference in their entirety.

BACKGROUND

1. Field

An embodiment of the present invention relates to a cosmetic vessel, and more particularly, to a cosmetic vessel in which a guide unit that diffuses cosmetics is directly combined with a piston of an airless pump so that the piston falls and an entire height of the cosmetic vessel may be reduced.

2. Description of the Related Art

Solid cosmetics such as foundations or liquid cosmetics such as sunscreens which are in widespread use help protect and lighten a user's skin and reduce wrinkles. The user may apply cosmetics onto a makeup puff and pat to spread the cosmetics on her face.

Cosmetics may be sold with a makeup puff accommodated in a cosmetic vessel. Generally, the puff may be accommodated in a lid of the cosmetic vessel. Therefore, to apply cosmetics, a user may open the lid to take the puff out of it, and press the puff onto the cosmetics with the user's fingers inserted under an elastic ribbon of the puff to pick up a predetermined amount of the cosmetics.

However, when the user directly presses the puff onto the cosmetics, cosmetics more than the user needs may be applied to the puff by the pressure the user applies on the puff, which may cause waste of the cosmetics. Therefore, recently, a method has been developed in which a sponge is impregnated with liquid cosmetics and the liquid cosmetics permeated into the sponge is discharged and supplied to the puff when the user presses the sponge with the puff.

However, in the above-described conventional cosmetics vessel, cosmetics more than the user needs may be discharged to the puff by the pressure the user presses the sponge. In addition, when the user presses the sponge too hard by mistake, the cosmetics may be discharged to a portion of the puff adjacent to the user's fingers as well as the surface of the puff which directly touches the user's skin, which may cause considerable inconvenience to the user.

In addition, conventionally, when the user applies the cosmetics to the user's skin such as a face by tapping the puff holding the cosmetics from the cosmetics-impregnated sponge, the user repeats pressing the puff against the cosmetics-impregnated sponge to apply the cosmetics. In this manner, however, the cosmetics may be seriously contaminated with viruses, molds, or bacteria on the skin. Furthermore, the contaminated microorganism in the cosmetics may keep growing until the user uses up the cosmetics. As a result, such contamination causes skin stimulation, skin problems, skin allergies, smell change, and the like. If the user experiences such inconvenience, the user will avoid using the cosmetics. Although the user wishes to use the cosmetic product for beauty, the cosmetics may rather cause personal hygiene problems and skin problems. Therefore, the user may feel strongly dissatisfied with the cosmetics.

For safe storage and use of cosmetics to avoid contamination by microorganism, a cosmetic vessel may have a structure to prevent cosmetic contents from contacting external contaminants. In addition, while only a desired amount of cosmetics is used, the remaining cosmetics are to be safely kept without contamination by microorganism.

The solution and review for such structure are to be earnestly sought. Thus, recommendation for use of cosmetics for beauty without finding a fundamental solution to it may rather cause serious skin side effects.

SUMMARY

An embodiment of the present invention relates to a cosmetic vessel capable of preventing cosmetics from being contaminated by using an airless pump. In the cosmetic vessel, a piston included in the airless pump is directly connected to a guide unit that diffuses the cosmetics and the piston falls due to the falling of the guide unit so that an entire height of the cosmetic vessel is reduced and the cosmetic vessel may be made compact.

A cosmetic vessel according to an embodiment of the present invention includes an airless pump configured to discharge cosmetics accommodated therein by using a piston that rises in a cylinder, a discharge plate provided at one side of the airless pump and having at least one discharge hole, and a guide unit provided between the airless pump and the discharge plate. A lower end of the guide unit is combined with the piston and rises or falls in a state of being integrated with the piston.

The airless pump includes the cylinder having a first hole so that the cosmetics are received in the airless pump, the hollow-shaped piston rising in the cylinder and having a second hole on an external circumference, and a piston ring provided around the piston and attached to an internal wall of the cylinder to open and close the second hole by rising.

The guide unit includes a piston combining unit protruding from a lower surface of the guide unit downward and combined with the piston.

The piston combining unit is combined with the piston while surrounding an upper end of the piston and rises or falls in a state of being integrated with the piston.

A lower end of the piston combining unit presses the piston ring while the piston combining unit falls and lets the piston ring fall.

An upper end of the piston is higher than a lower surface of the guide unit.

In the airless pump, when the piston falls due to the pressing of the guide unit, after the second hole deviates from the piston ring and is connected to an inside of the cylinder, since the piston ring falls due to the guide unit so that internal pressure of the cylinder rises, the cosmetics in the piston are discharged.

The airless pump further includes an elastic member having elastic force that pushes the guide unit upward.

The piston further includes a flange provide in a lower end of the piston to support the lower end of the piston ring.

In the airless pump, when the pressing of the guide unit is released and the piston rises due to the elastic member, after the second hole is blocked by the piston ring and is closed, since the piston ring rises due to the flange so that the internal pressure of the cylinder falls, the cosmetics are received to an inside of the cylinder.

The elastic member surrounds the piston combining unit and has an upper end thereof contact a lower surface of the guide unit to push the guide unit upward.

The guide unit includes a first flow path configured to diffuse the cosmetics discharged by the airless pump and a second flow path connected to the first flow path to transmit the cosmetics to the discharge hole.

The discharge plate is exposed to the outside and is formed of metal.

The discharge plate falls in a state of being integrated with the guide unit due to external pressure.

The airless pump discharges the cosmetics to the outside by the falling of the discharge plate.

The cosmetic vessel further includes a vessel main body configured to store the cosmetics.

The cosmetic vessel further includes a first frame unit provided outside the discharge plate, a second frame unit in which the discharge plate is settled and which is combined with a lower side of the first frame unit, and a third frame unit provided on circumferences of the first frame unit and the second frame unit and fixed to the vessel main body. The first frame unit and the second frame unit have a circumference of the discharge plate fixed therebetween and may rise or fall based on the third frame unit.

The cosmetic vessel further includes a frame unit provided outside the discharge plate and combined with the outside of the guide unit. The frame unit and the guide unit fix the circumference of the discharge plate therebetween.

The cosmetic vessel according to the present invention discharges the cosmetics by the airless pump having the piston that rises in the cylinder such that the guide unit is directly connected to the piston and diffuses the cosmetics to the discharge hole while letting the piston fall. Therefore, an entire height of the cosmetic vessel may be reduced.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
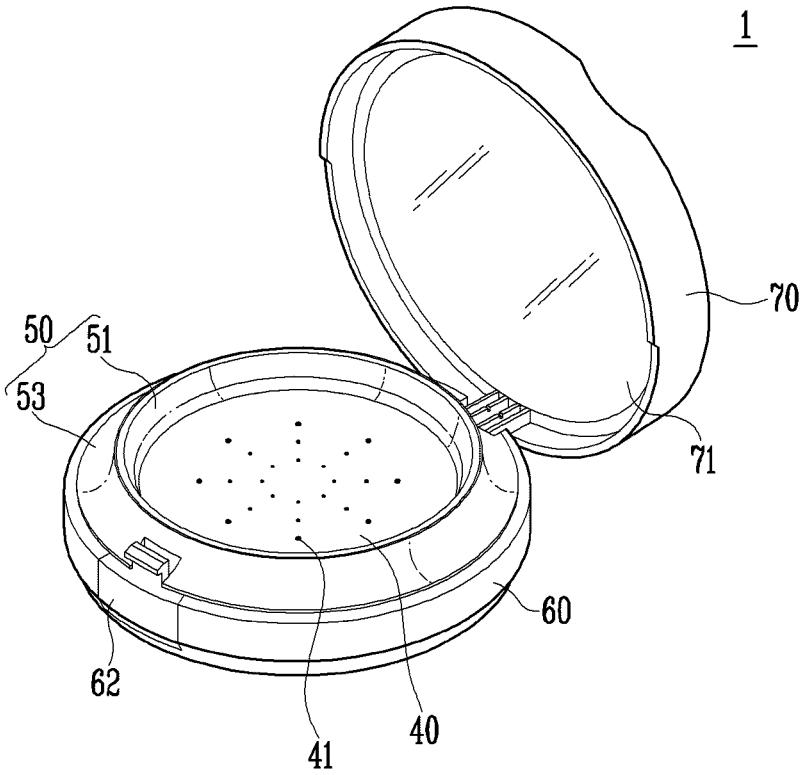
FIG. 1 is a perspective view of a cosmetic vessel according to an embodiment of the present invention.

Objects, features and advantages of the present invention will become readily apparent by reference to the following detailed description when considered in conjunction with the accompanying drawings. The drawings are not necessarily to scale and in some instances, proportions may have been exaggerated in order to clearly illustrate features of the embodiments. Moreover, detailed descriptions related to well-known functions or configurations will be ruled out omitted in order not to unnecessarily obscure clearly describe the subject matters of the present invention. Like reference numerals in the drawings denote like elements.

Hereinafter, various embodiments of the present disclosure will be described in detail with reference to the accompanying drawings.

Figure 2:
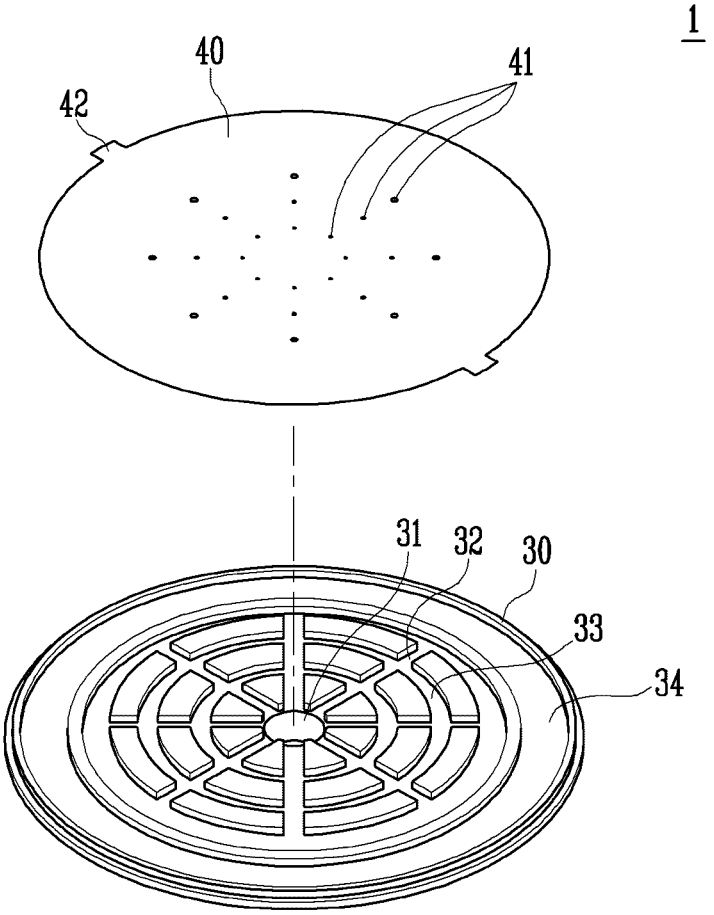
FIG. 2 is a perspective view of a discharge plate and a guide unit of a cosmetic vessel according to an embodiment of the present invention.
Figure 3:
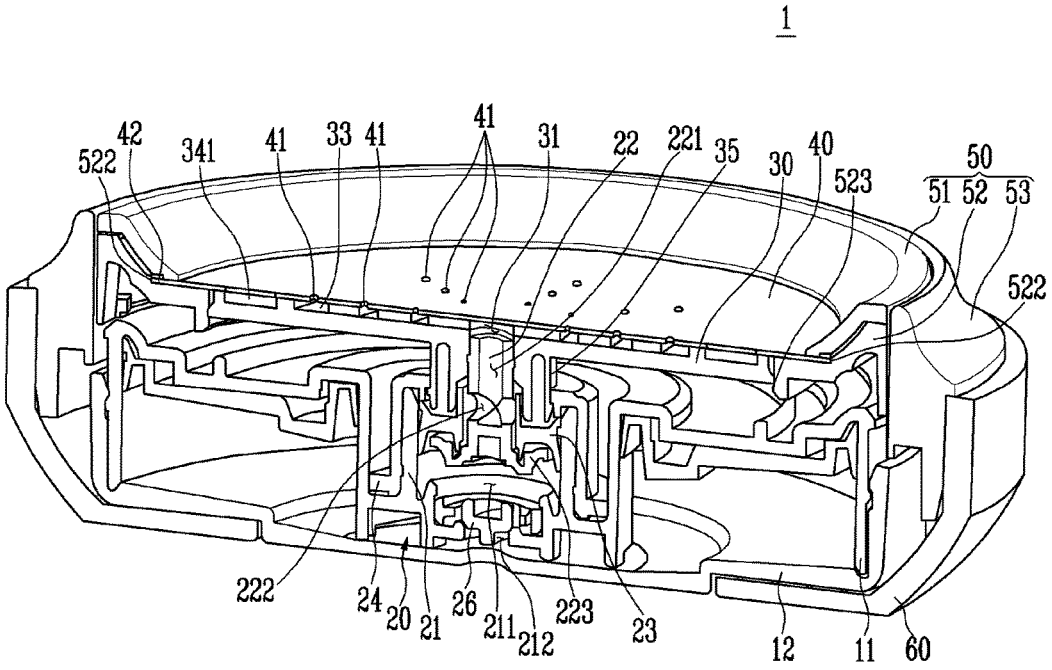
FIGS. 3 and 4 are cross-sectional views of a cosmetic vessel according to an embodiment of the present invention.
Figure 4:
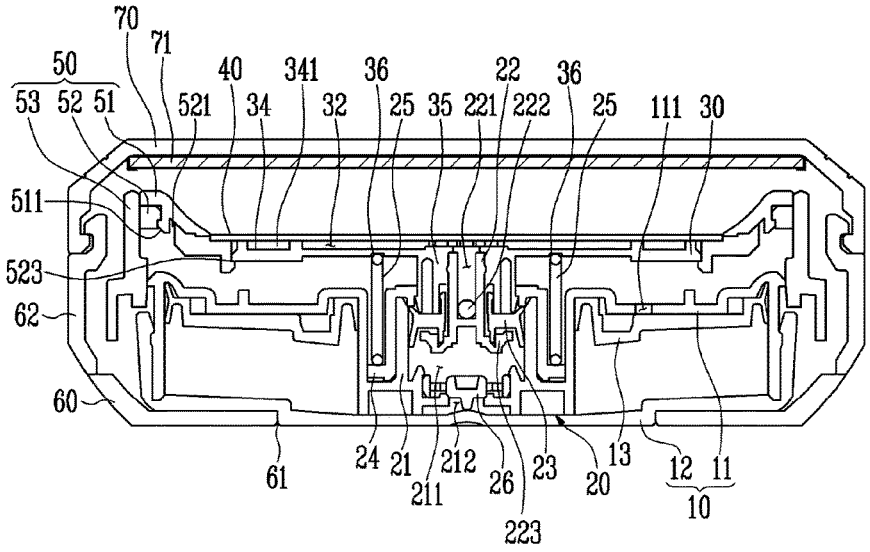

FIG. 1 is a perspective view of a cosmetic vessel according to an embodiment of the present invention. FIG. 2 is a perspective view of a discharge plate and a guide unit of a cosmetic vessel according to an embodiment of the present invention. FIGS. 3 and 4 are cross-sectional views of a cosmetic vessel according to an embodiment of the present invention.

Referring to FIGS. 1 through 4, the cosmetic vessel 1 according to the embodiment of the present invention includes a vessel main body 10, an airless pump 20, a guide unit 30, a discharge plate 40, a frame unit 50, an external cover 60, and a cover 70.

The vessel main body 10 accommodates cosmetics therein. The cosmetics stored in the vessel main body 10 may be discharged to the outside by the airless pump 20 to be described later. At this time, the cosmetics may include liquid cosmetics.

The vessel main body 10 includes a lower main body 12 and an upper main body 11. The lower main body 12 is combined with the upper main body 11 so that the vessel main body 10 may be sealed up. In order to easily accommodate the cosmetics in the vessel main body 10, the vessel main body 10 is divided into the lower portion and the upper portion.

Specifically, the lower main body 12 is dented inward. In order to store the cosmetics, when the cosmetics are contained in the lower main body 12 and the upper main body 11 is combined with an upper portion of the lower main body 12 so that the upper main body 11 covers the lower main body 12, the cosmetics may be simply filled in the vessel main body 10.

However, the present invention is not limited thereto. An additional cosmetic supply opening and closing hole (not shown) is formed in the vessel main body 10 and the opening and closing hole is sealed up after the cosmetics are accommodated in the vessel main body 10 through the opening and closing hole so that the cosmetics may be filled in the vessel main body 10. That is, a shape or a structure of the vessel main body 10 is not limited and the vessel main body 10 of any shape may be used if only a space that may accommodate the cosmetics is formed.

The airless pump 20 may be provided in the vessel main body 10. Specifically, the airless pump 20 may be provided in the center of the vessel main body 10. Therefore, the cosmetics accommodated in the vessel main body 10 may be discharged to an upper portion of the vessel main body 10 by the airless pump 20.

A pressing plate 13 may be formed in the vessel main body 10. The pressing plate 13 may prevent the vessel main body 10 from being damaged as a volume of the vessel main body 10 is reduced so that internal pressure is reduced when the cosmetics accommodated in the vessel main body 10 are discharged by the airless pump 20. That is, the pressing plate 13 falls as the cosmetics are discharged so that it is possible to uniformly maintain pressure of a space in which the cosmetics are stored. At this time, in order to allow the pressing plate 13 to fall, an air receiving hole 111 capable of receiving air from the outside may be formed in the upper portion of the vessel.

The airless pump 20 discharges the cosmetics accommodated in the vessel main body 10 to the outside. The airless pump 20 absorbs the liquid cosmetics accommodated in the vessel main body 10 and may discharge the absorbed liquid cosmetics to the outside of the vessel main body 10. At this time, the discharged cosmetics may be exposed to the outside a puff of a user may approach through the guide unit 30 and the discharge plate 40 to be described later.

The airless pump 20 includes a cylinder 21, a piston 22, a piston ring 23, a sealing member 24, and an elastic member 25.

The cylinder 21 with a hollow 211 is combined with the center of the vessel main body 10 and may be integrated with the vessel main body 10. The piston 22 and the piston ring 23 may be provided in the cylinder 21 and the sealing member 24 may be combined with the outside of the cylinder 21.

A first hole 212 for receiving the cosmetics may be formed in a lower portion of the cylinder 21. The first hole 212 may be connected to an inside of the vessel main body 10. When internal pressure of an inside of the cylinder 21 is lower than internal pressure of the vessel main body 10 (when the piston 22 rises), the cosmetics may be received to the inside of the cylinder 21 through the first hole 212. The cosmetics received to the inside of the cylinder 21 may be discharged to the outside through the piston 22 when the pressure of the inside of the cylinder 21 increases (when the piston 22 falls).

The piston 22 provided in the cylinder 21 rises and falls up and down and discharges the cosmetics in the vessel main body 10 to the outside. A hollow 221 through which the cosmetics may pass through may be formed in the piston 22 and an upper end of the hollow 221 becomes an exit of the airless pump 20.

A second hole 222 through which the cosmetics are received to the inside may be formed on an external circumference of the piston 22. Opening and closing of the second hole 222 are controlled by the piston ring 23. When the second hole 222 deviates from the piston ring 23, the second hole 222 and the inside of the cylinder 21 may be connected. To the contrary, when the piston ring 23 surrounds the second hole 222, the second hole 222 may be sealed up by the piston ring 23.

A flange 223 that protrudes to the outside may be provided on a lower surface of the piston 22. At this time, the flange 223 supports a lower end of the piston ring 23 and may push the piston ring 23 upward when the piston 22 rises.

The guide unit 30 is combined with the piston 22. The lower end of the guide unit 30 to be described later is directly combined with the piston 22 and may rise and fall in a state of being integrated with the piston 22. In the conventional airless pump 20, a stem for raising and lowering the piston 22 is provided in an upper portion of the piston 22 and a configuration such as the guide unit 30 is combined with the stem. However, according to the present invention, the stem is omitted in the airless pump 20 and the piston 22 and the guide unit 30 are directly combined with each other.

Therefore, according to the present invention, one part may diffuse the cosmetics and may raise and lower the piston 22 so that a total height of a cosmetic vessel 1 is reduced and the cosmetic vessel 1 may be made compact.

The piston ring 23 provided around the piston 22 and attached to an internal wall of the cylinder 21 rises and falls to open and close the second hole 222. The piston ring 23 is attached to the internal wall of the cylinder 21 to seal up a space between the piston 22 and the cylinder 21.

The piston ring 23 may rise and fall up and down by the piston combining unit 35 to be described and the flange 223 of the piston 22. At this time, upward movement of the piston ring 23 is implemented by the flange 223 and is limited by the piston combining unit 35 and downward movement of the piston ring 23 is implemented by the piston combining unit 35 and may be limited by the flange 223.

When the piston 22 falls, since the piston ring 23 remains attached to the internal wall of the cylinder 21, the second hole 222 of the piston 22 deviates from the piston ring 23 and may be connected to the inside of the cylinder 21. Then, when the piston ring 23 falls due to the piston combining unit 35, as the pressure of the inside of the cylinder 21 increases, the cosmetics in the cylinder 21 are received to the piston 22.

To the contrary, when the piston 22 rises, the piston ring 23 rises due to the flange 223 to block the second hole 222 of the piston 22. In this case, as the pressure of the inside of the cylinder 21 is reduced while the piston ring 23 rises, the cosmetics are received from the vessel main body 10 to the cylinder 21.

The sealing member 24 is combined with the external circumference of the cylinder 21 and seals up a circumference of the upper end of the cylinder 21. The piston 22 and the piston combining unit 35 may rise in the hollow 211-shaped cylinder 21. The sealing member 24 seals up a circumference of the piston combining unit 35 and may prevent the cosmetics from leaking from the upper portion of the cylinder 21 to the outside of the piston combining unit 35.

The sealing member 24 may be cylindrical such that a lower end of the sealing member 24 protrudes to the outside. At this time, the lower end of the sealing member 24 may support a lower end of the elastic member 25.

The elastic member 25 provides elastic force to the guide unit 30 in an upper direction. The elastic member 25 may be a spring. The lower end of the elastic member 25 is settled in the sealing member 24 and an upper end of the elastic member 25 contacts a lower surface of the guide unit 30 so that the elastic member 25 may push the guide unit 30 upward.

Therefore, the piston 22 may remain rising due to the elastic member 25. When a user presses the discharge plate 40 by a puff, a finger or etc., the guide unit 30 provided in a lower end of the discharge plate 40 lets the piston 22 fall so that the cosmetics may be discharged.

The elastic member 25 may surround the piston combining unit 35 around the piston combining unit 35. The upper end of the elastic member 25 contacts the lower surface of the guide unit 30 and may push the guide unit 30 upward. At this time, a circular groove 36 in which the upper end of the elastic member 25 is settled may be provided in the lower surface of the guide unit 30.

Hereinafter, an operation principle of the airless pump will be described.

First, the guide unit 30 falls in a state of being integrated with the discharge plate 40 due to the falling of the discharge plate 40 and the piston 22 also falls while the piston combining unit 35 provided in the guide unit 30 falls. Since the piston ring 23 does not fall due to friction against an internal surface of the cylinder 21, the second hole 222 formed on the external circumference of the piston 22 deviates from the piston ring 23 and is connected to an internal space of the cylinder 21.

At this time, when the guide unit 30 continuously falls, the piston ring 23 is pressed by the piston combining unit 35, falls, and reduces a volume of the internal space of the cylinder 21 so that pressure of the internal space of the cylinder 21 increases. Therefore, the cosmetics positioned in the internal space of the cylinder 21 with the increased pressure are discharged along an inside of the piston 22 through the second hole 222 of the external circumference of the piston 22 connected to the internal space of the cylinder 21. In this case, in order to prevent the cosmetics from flowing backward, in the airless pump 20, a flow backward preventing member 26 may be provided in the first hole 212 formed in a lower portion of the center of the cylinder 21.

To the contrary, when the piston combining unit 35 rises due to the elastic member 25 as pressure applied to the discharge plate 40 and the guide unit 30 is released, the piston ring 23 stops due to friction against the internal surface of the cylinder 21 like in the falling of the piston ring 23. At this time, the second hole 222 of the piston 22 is blocked by the piston ring 23 and may be closed.

Then, when the piston ring 23 is supported by the flange 223 of the piston 22 and rises as the piston 22 continuously rises, since the volume of the internal space of the cylinder 21 increases, the internal space of the cylinder 21 has low pressure. Therefore, the cosmetics accommodated in the vessel main body 10 are naturally received to the inside of the cylinder 21.

The airless pump 20 may discharge the cosmetics accommodated in the vessel main body 10 to the outside by repeating such processes.

The guide unit 30 is provided between the airless pump 20 and the discharge plate 40 and transmits the cosmetics discharged by the airless pump 20 to discharge holes 41 of the discharge plate 40.

The guide unit 30 may include a first flow path 32 for diffusing the cosmetics discharged by the airless pump 20 and a second flow path 33 for transmitting the diffused cosmetics to the discharge holes 41. The second flow path 33 may be connected to the first flow path 32.

The first flow path 32 may be radially provided based on the exit of the airless pump 20. For example, the first flow path 32 may radiate from the exit to be star or flower-shaped. At this time, the first flow path 32 may be point symmetry based on the exit and a width of the first flow path 32 through which the cosmetics pass may remain the same or may change (become smaller or larger) away from the exit. That is, the first flow path 32 may be continuous in a direction away from the exit of the airless pump 20 and may be non-continuous in a direction along a virtual circle based on the exit of the airless pump 20.

The second flow path 33 may be point symmetry based on the exit of the airless pump 20 and may be circular based on the exit of the airless pump 20. At this time, the second flow path 33 may be concentric circular such that a width through which the cosmetics pass may remain the same or may change. The concentric circle may be connected to the first flow path 32. That is, the second flow path 33 is non-continuous in a direction away from the exit of the airless pump 20 and may be connected to the non-continuous portion of the first flow path 32.

In the center of the guide unit 30, the outlet 31 connected to the exit of the airless pump 20 is provided. The outlet 31 is not directly connected to the second flow path 33 but may be directly connected to the first flow path 32. When the cosmetics are discharged by the airless pump 20, the cosmetics may be diffused into the first flow path 32 through the outlet 31 of the guide unit 30.

Then, the cosmetics are diffused into the second flow path 33 connected to the first flow path 32 and may be filled in the circular second flow path 33. The cosmetics filled in the second flow path 33 are discharged to the discharge holes 41 of the discharge plate 40. For this purpose, the second flow path 33 may be connected to the plurality of discharge holes 41 provided in the discharge plate 40.

The first flow path 32 may not be connected to the discharge holes 41 and may be connected to the discharge holes 41 only through the second flow path 33. That is, after the cosmetics are diffused into the first flow path 32 through the outlet 31 of the guide unit 30, the cosmetics are transmitted to the second flow path 33 and may be discharged to the outside through the discharge hole 41.

In accordance with an assembling angle between the guide unit 30 and the discharge plate 40, since at least parts of the discharge holes 41 provided in the discharge plate 40 may be connected to the first flow path 32, the cosmetics are basically filled in the second flow path 33 through the first flow path 32. However, the cosmetics may directly leak from the first flow path 32 to the discharge holes 41 of the discharge plate 40.

That is, the guide unit 30 includes the radial first flow path 32 and the circular second flow path 33. The second flow path 33 is connected to the first flow path 32 so that an assembling direction between the discharge plate 40 and the guide unit 30 may not be limited, which will be described in more detail in describing the discharge plate 40.

The guide unit 30 may include a sealing path 34 provided around the second flow path 33 and a packing member 341 settled in the sealing path 34. When the cosmetics are diffused into the second flow path 33 through the first flow path 32, in order to prevent the cosmetics from leaking to the outside through a gap generated between the guide unit 30 and the discharge plate 40, the packing member 341 is settled in the sealing path 34 and blocks the gap between the discharge plate 40 and the guide unit 30.

The sealing path 34 may surround the second flow path 33. For example, the sealing path 34 may be circular like the second flow path 33. However, the present invention is not limited thereto. In addition, the packing member 341 may be formed of an elastic member such as rubber and may be slightly compressed when the discharge plate 40 and the guide unit 30 are tightly fixed by the frame unit 50 to be described later. In addition, at least an upper surface and a lower surface of the packing member 341 have adhesive force so that the guide unit 30 and the discharge plate 40 may remain attached.

As described above, in the lower end of the guide unit 30, the piston combining unit 35 may protrude downward. The piston combining unit 35 is a portion directly combined with the piston 22, the piston combining unit 35 is combined with the piston 22 while surrounding the upper end of the piston 22 and may rise and fall in a state of being integrated with the piston 22.

The piston combining unit 35 may let the piston 22 fall while falling when the discharge plate 40 is pressed by external force such as a user's puff, finger or etc. For this purpose, the piston combining unit 35 and the piston 22 may be firmly integrated by a protrusion (reference numeral is not shown) and groove (reference numeral is not shown) structure or a screw combining structure.

The piston combining unit 35 lets the piston 22 fall while falling and may let the piston ring 23 fall. The piston combining unit 35 may be hollow-shaped such that the upper end of the piston 22 is received therein. The hollow of the piston combining unit 35 may have the same diameter while being connected to the outlet 31 of the guide unit 30.

At this time, the piston 22 may be combined with the piston combining unit 35 so that the upper end of the piston 22 is higher than the lower surface of the guide unit 30. That is, the upper end of the piston 22 may be inserted into a part of the outlet 31 through the piston combining unit 35.

The piston combining unit 35 may be surrounded by the elastic member 25. At this time, since the elastic member 25 contacts the lower surface of the guide unit 30, the piston combining unit 35 may indirectly receive elastic force caused by the elastic member 25. An external side of a lower end of the piston combining unit 35 may be blocked by the sealing member 24. Therefore, although the elastic member 25 continuously pushes the piston combining unit 35, the rising of the piston combining unit 35 is prevented by the sealing member 24.

As described above, in the guide unit 30 according to the current embodiment, the piston combining unit 35 that protrudes from the lower surface of the guide unit 30 is directly combined with the piston 22 of the airless pump 20 and the cosmetics leak from the piston 22 to the discharge holes 41 of the discharge plate 40 through the outlet 31 and the first flow path 32 of the guide unit 30 when the guide unit 30 falls. Therefore, according to the current embodiment, the cosmetic vessel 1 may be made slim.

The discharge plate 40 is provided at one side of the airless pump 20 by which the cosmetics are discharged, may include the plurality of discharge holes 41, and is exposed to the outside. The discharge plate 40 may be formed of an anticorrosive metal material such as steel, stainless steel, copper (Cu), zinc (Zn), tin (Sn), and aluminum (Al), an alloy of the above, or a plated metal material. In particular, when the discharge plate 40 is plated by chrome (Cr), Cu, silver (Ag), or gold (Au), corrosion resistance, contamination resistance, antibiosis, and beauty are endowed so that users may be satisfied.

The discharge plate 40 has a thickness ranging from 0.1 mm to 1 mm (preferably, 0.2 mm to 0.3 mm) thick and may be formed of an anticorrosive metal material such as Al, an Al alloy, and stainless or a material such as ceramic.

Specifically, the discharge plate 40 may be formed of SUS 304 material in SUS 300 based materials with high anticorrosion, acid-resistance, and heat-resistance as stainless. In particular, the discharge plate 40 may be formed of a 304J1 material in order to improve antibiosis and sanitation.

According to the current embodiment, the present invention is not limited thereto. The discharge plate 40 may be formed of at least one of 301L, 304L, 304LN, 304N1, 305EG, 309S, 310S, 316, 316L, 316LN, 316Ti, 317L, 321, 347, 329J3L, and 329LD.

Therefore, according to the current embodiment, the discharge plate 40 formed of SUS 300 based stainless is used so that an upper surface of the discharge plate 40 in which the cosmetics discharged by the airless pump 20 are settled and which is continuously contaminated by the cosmetics may remain clean and corrosion may be effectively prevented.

In addition, according to the current embodiment, since the discharge plate 40 formed of the metal material is exposed to the outside so that heat may be efficiently emitted and temperature of the cosmetics may be reduced, a user may be satisfied.

According to the current embodiment, since the cosmetics are discharged by the airless pump 20, although air is received through the discharge holes 41 formed in the discharge plate 40, the air is not transmitted to the cosmetics accommodated in the airless pump 20 so that it is possible to prevent the cosmetics from being contaminated.

The upper surface of the discharge plate 40 is contaminated by the cosmetics. When the user rubs the cosmetics on the upper surface of the discharge plate 40 by using the puff, due to powder included in the cosmetics, the upper surface of the discharge plate 40 may be abraded. Therefore, according to the current embodiment, the upper surface of the discharge plate 40 is coated with or plated by a specific material so that, although the user rubs the cosmetics on the upper surface of the discharge plate 40, it is possible to prevent durability of the discharge plate 40 from deteriorating.

At this time, the discharge plate 40 may be plated by metal different from metal that forms the discharge plate 40, for example, Cr. Specifically, the discharge plate 40 may be plated by trivalent Cr or hexavalent Cr.

As described above, according to the current embodiment, the discharge plate 40 is formed of a metal material and at least one surface thereof is plated by Cr so that it is possible to secure sanitation, antibiosis, and durability, to let the cosmetics on the discharge plate 40 easily wiped away, and to improve convenience of the user. According to the current embodiment, an additional member is not put on the upper surface of the discharge plate 40 so that the upper surface of the discharge plate 40 is directly exposed to the outside.

The discharge plate 40 may be formed of a base metal material such as synthetic resin, ceramic, glass, and wood and may be coated (plated) in order to prevent the discharge plate 40 from being abraded by the cosmetics. When the discharge plate 40 is formed of a material with higher strength than that of the powder included in the cosmetics, the discharge plate 40 may not be coated.

In the discharge plate 40, the discharge holes 41 may be radially provided. At this time, the discharge holes 41 may have diameters ranging from 0.1 mm to 1 mm, which are very small. The diameters of the discharge holes 41 are made small in order to let the user easily control an amount of the cosmetics discharged to the upper portion of the discharge plate 40 through the airless pump 20 and to prevent foreign substances from being received to the inside through the discharge holes 41.

The discharge holes 41 may be radially provided based on the center of the discharge plate 40 by a distance of 45 degrees. The three discharge holes 41 may be provided in parallel in a uniform direction away from the center of the discharge plate 40. At this time, the three discharge holes 41 provided in parallel may have diameters of 0.3 mm, 0.4 mm, and 0.5 mm such that the discharge hole 41 close to the center of the discharge plate 40 comes first.

According to the current embodiment, since the discharge plate 40 including the above discharge holes 41 with the very small diameters is used for the airless pump 20, it is possible to prevent the cosmetics accommodated in the vessel main body 10 from contacting the air and to prevent partial components included in the cosmetics from volatilizing.

As the discharge holes 41 have the very small diameters, when the discharge plate 40 is molded, it is difficult to correctly manufacture the discharge holes 41. Therefore, according to the current embodiment, after manufacturing the discharge plate 40, the discharge holes 41 are molded by an etching method so that the discharge holes 41 with the diameter of 0.1 mm may be manufactured.

When the discharge holes 41 are radially provided and the guide unit 30 has only the radially provided first flow path 32, in order to let the cosmetics leak to the discharge holes 41 through the first flow path 32 of the guide unit 30, the assembling directions of the guide unit 30 and the discharge plate 40 must be limited so that the discharge holes 41 and the first flow path 32 correspond.

However, according to the current embodiment, the circular second flow path 33 connected to the first flow path 32 is additionally provided in the guide unit 30 so that the assembling directions of the discharge plate 40 and the guide unit 30 may not be limited. At this time, the second flow path 33 may be concentric circular as described above and the respective circles may correspond to the discharge holes 41 provided in parallel.

When the guide unit 30 and the discharge plate 40 are assembled so that the discharge holes 41 of the discharge plate 40 correspond to the first flow path 32 of the guide unit 30, the cosmetics may leak from the exit of the airless pump 20 to the discharge holes 41 through the outlet 31 and the first flow path 32 of the guide unit 30.

Although the guide unit 30 and the discharge plate 40 are assembled so that the discharge holes 41 of the discharge plate 40 cross the first flow path 32 of the guide unit 30, according to the current embodiment, the cosmetics leak from the exit of the airless pump 20 to the discharge holes 41 through the outlet 31, the first flow path 32, and the second flow path 33 of the guide unit 30.

That is, according to the current embodiment, since the flow paths of the guide unit 30 are provided so that the cosmetics are smoothly discharged although the assembling directions of the discharge plate 40 and the guide unit 30 are not the same, manufacturing processes and manufacturing expenses may be significantly improved.

The frame unit 50 is provided around the guide unit 30 and fixes the discharge plate 40. The frame unit 50 includes a first frame unit 51, a second frame unit 52, and a third frame unit 53.

The ring-shaped first frame unit 51 is provided outside the discharge plate 40. The first frame unit 51 is exposed to the outside together with the third frame unit 53. The first frame unit 51 is inclined such that a height thereof is reduced toward the center of the discharge plate 40 and may be attached to the upper surface of the discharge plate 40. Therefore, the first frame unit 51 may improve user's convenience by preventing the cosmetics from being received between the discharge plate 40 and the first frame unit 51 when the user's puff rubs the discharge plate 40.

The user may directly press the discharge plate 40 to discharge the cosmetics and may press the first frame unit 51 together with the discharge plate 40 or separately from the discharge plate 40 to discharge the cosmetics. When the discharge plate 40 is pressed, the first frame unit 51 may fall. When the first frame unit 51 is pressed, the discharge plate 40 may fall.

The ring-shaped second frame unit 52 in which the discharge plate 40 is settled is combined with a lower side of the first frame unit 51. A circumference of the discharge plate 40 may be fixed between the second frame unit 52 and the first frame unit 51. For this purpose, in the second frame unit 52, a groove 521 for the combination of the first frame unit 51 may be provided and a protrusion 511 of the first frame unit 51 may be received in the groove 521. Positions of the protrusion 511 and the groove 521 may be exchanged and the first frame unit 51 and the second frame unit 52 may be attached by other various methods.

The second frame unit 52 may be blocked by the first frame unit 51 and may not be exposed to the outside. The first frame unit 51 and the second frame unit 52 may rise with the circumference of the discharge plate 40 fixed. At this time, the first frame unit 51 and the second frame unit 52 may rise and fall based on the third frame unit 53.

The guide unit 30 may be combined with a lower end of the second frame unit 52. At this time, due to a step difference 523 provided in the lower end of the second frame unit 52, the guide unit 30 may be settled in an opening of the ring-shaped second frame unit 52.

The second frame unit 52 may support the circumference of the discharge plate 40. At this time, a protrusion 42 provided on the circumference of the discharge plate 40 is received in the groove 522 of the second frame unit 52 so that the discharge plate 40 may be fixed. That is, although the assembling directions of the discharge plate 40 and the guide unit 30 are not limited, the assembling direction of the discharge plate 40 settled in the second frame unit 52 may be limited by the protrusion 42 of the discharge plate 40 and the groove 522 of the second frame unit 52. The protrusion 42 of the discharge plate 40 may be omitted in order not to limit the assembling directions of the discharge plate 40 and the second frame unit 52.

According to the present invention, the second frame unit 52 is omitted and the circumference of the guide unit 30 extends to the outside so that the second frame unit 52 may be implemented. In this case, the outside of the guide unit 30 expands so that the discharge plate 40 is settled in the guide unit 30 having a larger area than the discharge plate 40 and the first frame unit 51 may be combined so that the outside of the discharge plate 40 is covered with the outside of the guide unit 30. At this time, the first frame unit 51 is combined with outside of the guide unit 30 and the outside of the discharge plate 40 by double-molding to be integrated with the guide unit 30 and the discharge plate 40.

The ring-shaped third frame unit 53 is provided on circumferences of the first frame unit 51 and the second frame unit 52 and is fixed to the vessel main body 10. Since the third frame unit 53 is fixed to the vessel main body 10, the third frame unit 53 does not rise and fall. The discharge plate 40 and first frame unit 51, the second frame unit 52, and the guide unit 30 fixed with the discharge plate 40 interposed may rise and fall at an internal side of the third frame unit 53.

As described above, according to the current embodiment, the frame unit 50 has a triple structure so that a height of the guide unit 30 and a combination height of the frame unit 50 are reduced. Therefore, the cosmetic vessel 1 is made slim and portability of the cosmetic vessel 1 may be improved.

An external cover 60 surrounds a circumference of the vessel main body 10. The external cover 60 has a space in which the vessel main body 10 is settled. An opening 61 through which the vessel main body 10 is exposed may be formed in the external cover 60 in a lower portion. When the user pushes the vessel main body 10 upward through the opening 61 of the external cover 60, the vessel main body 10 is separated so that the vessel main body 10 may be exchanged.

An upper surface of the external cover 60 may be sequentially covered with the third frame unit 53, the first frame unit 51, and the discharge plate 40 in a direction from the outside to the center. Therefore, since the user may not see the first and second flow paths 32 and 33 of the guide unit 30 and the airless pump 20 in the outside, the cosmetic vessel according to the current embodiment has an improved external appearance so that the user may be satisfied.

A button 62 may be provided in the external cover 60 and the button 62 may be integrated with a latch (reference numeral is not shown). When the user presses the button 62, the latch also moves in a pressing direction so that the latch deviates from a cover 70 and the cover 70 may be opened.

The cover 70 opens and closes one side (an upper side according to the current embodiment) of the external cover 60. One side of the cover 70 may be hinge combined with the external cover 60 and rotates based on a center of a hinge so that an upper portion of the external cover 60 may be opened. At this time, the cover 70 may be fixed in a state in which the upper portion of the external cover 60 is sealed up by the above-described latch.

The cover 70 is hinge combined with the external cover 60 such that a spring is provided in a hinge combined portion. When the locking of the cover 70 is released by the button 62, the cover 70 may be automatically opened.

A mirror 71 may be provided at an internal side of the cover 70 so that the user opens the cover 70 and presses the discharge plate 40 and/or the first frame unit 51 while looking at the mirror 71 to discharge the cosmetics from the vessel main body 10.

As described above, according to the present invention, the guide unit 30 is directly combined with the piston 22 of the airless pump 20 and the frame unit 50 has the triple structure so that the cosmetic vessel 1 is made slim. Therefore, it is possible to improve portability of the cosmetic vessel 1, the external appearance of the cosmetic vessel 1, and combination force of parts.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A cosmetic vessel comprising:

an airless pump configured to discharge cosmetics;

a discharge plate provided at one side of the airless pump and having at least one discharge hole; and a guide unit provided between the airless pump and the discharge plate, wherein the airless pump comprises:

a cylinder having a first hole configured to receive the cosmetics in the airless pump;

a piston with a hollow-shape, rising in the cylinder and having a second hole on an external circumference; and a piston ring provided around the piston and attached to an internal wall of the cylinder to open and close the second hole by rising, wherein the guide unit comprises a piston combining unit protruding from a lower surface of the guide unit downward, the piston combining unit being combined with the piston, and wherein the piston combining unit presses the piston ring downward while the guide unit falls.

2. The cosmetic vessel of claim 1, wherein the airless pump comprises:

a sealing member combined with an external circumference of the cylinder and configured to seal a circumference of the piston combining unit at an upper end of the cylinder, and wherein an external side of a lower end of the piston combining unit is blocked by the sealing member.

3. The cosmetic vessel of claim 1, wherein the piston combining unit is integrated with the guide unit so that an entire height of the cosmetic vessel may be reduced.

4. The cosmetic vessel of claim 3, wherein the piston combining unit is directly combined with the piston while surrounding an upper end of the piston and rises or falls in a state of being integrated with the piston.

5. The cosmetic vessel of claim 1, wherein an outlet connected to an exit of the airless pump is provided in a center of the guide unit, wherein the piston combining unit is hollow-shaped and is connected to the outlet, and wherein an upper end of the piston is inserted into a part of the outlet through the piston combining unit so that the upper end of the piston is higher than a lower surface of the guide unit.

6. The cosmetic vessel of claim 5, wherein the guide unit comprises:

a first flow path configured to diffuse the cosmetics discharged by the airless pump; and a second flow path connected to the first flow path to transmit the cosmetics to the discharge hole.

7. The cosmetic vessel of claim 1, wherein, in the airless pump, when the piston falls due to pressing of the guide unit, after the second hole deviates from the piston ring and is connected to an inside of the cylinder, since the piston ring falls due to the guide unit so that internal pressure of the cylinder rises, the cosmetics in the piston are discharged.

8. The cosmetic vessel of claim 1, wherein the airless pump further comprises an elastic member having elastic force that pushes the guide unit upward.

9. The cosmetic vessel of claim 8, wherein the piston further comprises a flange provided in a lower end of the piston to support a lower end of the piston ring.

10. The cosmetic vessel of claim 9, wherein, in the airless pump, when pressing of the guide unit is released and the piston rises due to the elastic member, after the second hole is blocked by the piston ring and is closed, since the piston ring rises due to the flange so that the internal pressure of the cylinder falls, the cosmetics are received to an inside of the cylinder.

11. The cosmetic vessel of claim 8, wherein the elastic member surrounds the piston combining unit and has an upper end thereof contact a lower surface of the guide unit to push the guide unit upward.

12. The cosmetic vessel of claim 1, wherein the discharge plate is exposed to the outside and is formed of metal.

13. The cosmetic vessel of claim 1, wherein the discharge plate falls in a state of being integrated with the guide unit due to external pressure.

14. The cosmetic vessel of claim 1, wherein the airless pump discharges the cosmetics to the outside by the falling of the discharge plate.

15. The cosmetic vessel of claim 1, further comprising a vessel main body configured to store the cosmetics.

16. The cosmetic vessel of claim 15, further comprising:

a first frame unit provided outside the discharge plate;

a second frame unit in which the discharge plate is settled and which is combined with a lower side of the first frame unit; and a third frame unit provided on circumferences of the first frame unit and the second frame unit and fixed to the vessel main body, wherein the first frame unit and the second frame unit have a circumference of the discharge plate fixed therebetween and may rise or fall based on the third frame unit.

17. The cosmetic vessel of claim 1, further comprising a frame unit provided outside the discharge plate and combined with the outside of the guide unit, wherein the frame unit and the guide unit fix the circumference of the discharge plate therebetween.

* * * * *